US006109785A

United States Patent [19]

Ross et al.

[11] Patent Number: 6,109,785

[45] Date of Patent: Aug. 29, 2000

[54] BULK BAG AND METHOD OF PRODUCING SAME

[75] Inventors: Kurt D. Ross, El Paso, Tex.; Randy R. Sullinger, Alpharetta, Ga.

[73] Assignee: Grayling Industries, Inc., Alpharetta, Ga.

[21] Appl. No.: 09/477,385

[22] Filed: Jan. 4, 2000

Related U.S. Application Data

[62] Division of application No. 09/013,274, Jan. 26, 1998, Pat. No. 6,010,245.

[51] Int. Cl.[7] ..... B65D 30/06

[52] U.S. Cl. ..... 383/117; 383/105; 383/111; 383/119; 383/120; 383/903

[58] Field of Search ..... 383/105, 111, 383/117, 119, 120, 903, 38

[56] References Cited

U.S. PATENT DOCUMENTS

| | | | |
|---|---|---|---|
| 426,774 | 4/1890 | Claussen | 383/120 |
| 3,168,887 | 2/1965 | Bodel | 119/269 |
| 3,974,958 | 8/1976 | Ruda | 383/9 |
| 4,096,987 | 6/1978 | Rodish | 383/120 X |
| 4,557,956 | 12/1985 | Volpert et al. | 428/34.1 |
| 4,597,102 | 6/1986 | Nattrass | 383/105 |
| 4,834,255 | 5/1989 | Boots | 229/199 |
| 5,071,025 | 12/1991 | Boots | 229/117.35 |
| 5,073,035 | 12/1991 | Williams | 383/19 |
| 5,104,236 | 4/1992 | LaFleur | 383/17 |
| 5,154,266 | 10/1992 | Bieber et al. | 383/117 X |
| 5,222,812 | 6/1993 | Cuddy et al. | 383/17 |
| 5,288,150 | 2/1994 | Bearman | 383/38 |
| 5,316,387 | 5/1994 | Polett et al. | 383/119 |
| 5,328,267 | 7/1994 | Cuddy et al. | 383/17 |
| 5,328,268 | 7/1994 | LaFleur | 383/119 |
| 5,358,335 | 10/1994 | LaFleur | 383/120 X |
| 5,375,929 | 12/1994 | Bergmoser | 383/38 |
| 5,413,199 | 5/1995 | Clement | 383/117 X |
| 5,468,528 | 11/1995 | Schnaars et al. | 428/35.7 |
| 5,482,318 | 1/1996 | Sollars, Jr. | 280/743.1 |
| 5,538,155 | 7/1996 | Hoekstra | 220/495.01 |
| 5,556,205 | 9/1996 | Gallie et al. | 383/105 X |
| 5,660,478 | 8/1997 | Alack et al. | 383/119 |
| 5,664,887 | 9/1997 | LaFleur | 383/119 |
| 5,762,241 | 6/1998 | Ross | 383/119 |
| 6,010,245 | 1/2000 | Ross et al. | 383/105 X |

FOREIGN PATENT DOCUMENTS

| | | | |
|---|---|---|---|
| 2417109 | 10/1907 | Germany | 383/119 |
| 10985 | 10/1907 | United Kingdom | 383/120 |

*Primary Examiner*—Jes F. Pascua
*Attorney, Agent, or Firm*—Kennedy, Davis & Hodge LLP

[57] ABSTRACT

A bulk bag has side walls and a bottom in which a liner is inserted made of a flexible plastic material. The liner has a bottom and a plurality of sides and at least one frame member extending inwardly from the sides substantially along a plane oriented substantially parallel with the bottom.

4 Claims, 4 Drawing Sheets

BULK BAG AND METHOD OF PRODUCING SAME

This application is a divisional of application Ser. No. 09/013,274 filed Jan. 26, 1998, now U.S. Pat. No. 6,010,245 issued Jan. 4, 2000.

TECHNICAL FIELD

This invention relates generally to bulk bags and specifically to bulk bag liners and to method of producing such liners.

BACKGROUND OF THE INVENTION

Free flowing bulk materials, such as granular products and liquids, are commonly stored and shipped in large bulk bags. These bags are typically made of air pervious, flexible woven materials. For many types of bulk products it is necessary to line the interior of the fabric bag with an air and liquid impervious liner. Typically these liners are made of plastic sheet material such as polyethylene.

Being flexible, bulk bags tend to bulge outwardly when filled with bulk materials. When this occurs their shape changes from squared off or rectangular to round. When this occurs they become difficult to handle and to store with spacial efficiency.

Attempts have heretofore been made at solving the problem of bulging. This has mainly been done by incorporating upright panels that bridge the insides of the bag corners. Examples of these are shown in U.S. Pat. Nos. 4,834,255, 5,071,025, 5,222,812, 5,328,267, 5,468,528 and 5,538,155. Though these corner panels do reasonably well in limiting bulging, they are costly to manufacture. Also, sometimes the corner spaces located behind the panels are slow to fill and are incompletely filled with bulk materials, even though they do have holes. When this occurs the full capacity of the bulk bag is not used.

Accordingly, it is seen that a need remains for a bulk bag with liner that is relatively easy and economic to produce and effective in restricting bulging without limiting fill capacity. It is to the provision of such a bulk bag and method of producing such a bag that the present invention is primarily directed.

SUMMARY OF THE INVENTION

Briefly described, bulk bag bulging is restricted by providing its liner with one or more frame members that extend inwardly from the liner sides substantially along a plane oriented parallel with the bottom of the liner. The frame may be made in the form of coplanar sealed pleats formed in the flexible material that provides the liner sides. Alternatively, the frame may be in the form of one or more woven scrims that are sealed to tucked in ends of distinct liner wall sections.

In a preferred form of the invention a bulk bag has sidewalls and a bottom in which a liner is inserted made of a flexible plastic material. The liner has a bottom and a plurality of sides and at least one frame member extending inwardly from the sides substantially along a plane oriented substantially parallel with the liner bottom.

In another preferred form a bulk bag has side walls and a bottom in which a liner is inserted that is made of flexible plastic material. The liner has a bottom and side walls and an open mesh screen, preferably in the form of a woven scrim, mounted to its side walls over the floor. So constructed the bulk bag may be filled by pouring bulk materials into the liner which pass through the mesh screen and accumulate both below and above the mesh screen. The mesh screen limits bulging of the bulk while filled.

In yet another form a bulk bag has side walls and a bottom in which a liner is inserted made of flexible plastic material. The liner has a bottom and side walls. The side walls have inturned, overlapped, sealed flanges that form a reinforced frame over the liner floor to limit bulging of the bulk bag when filled with bulk material.

In still another form a method of producing a bulk bag liner comprises the steps of providing a tube of flexible plastic sheet material having side walls and tucking in the side walls to form folds in each wall disposed substantially along a common plane. The folds in each wall are sealed together to form pleats.

BRIEF DESCRIPTION OF THE DRAWING

FIG. 7 is a perspective view of a bulk bag liner incorporating principles of the invention in another preferred form while

DETAILED DESCRIPTION

Figure 1:
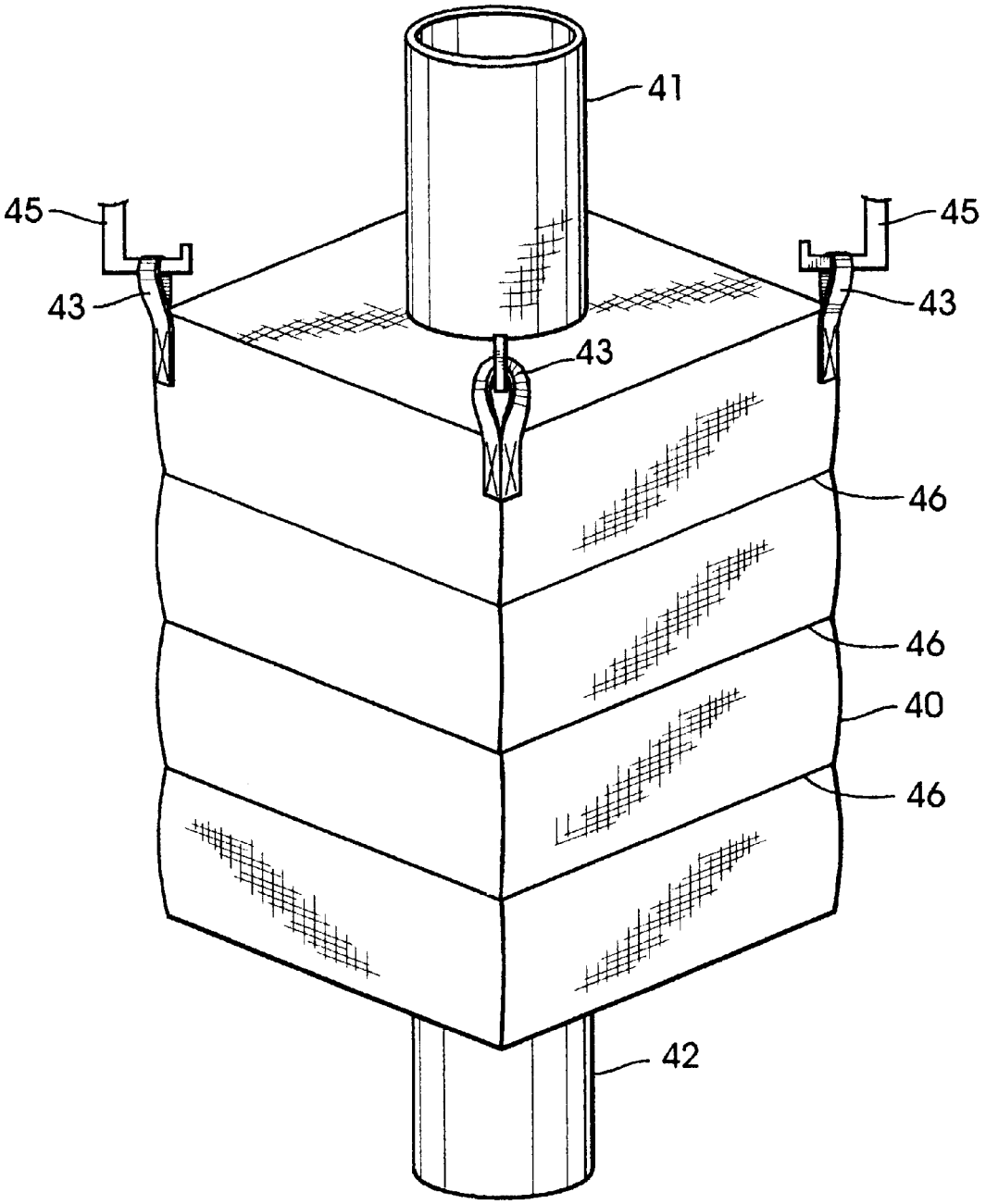
FIG. 1 is a perspective view of a filled bulk bag with the new liner.

With reference next to the drawing, there is shown in FIGS. 2–6 a method of producing a bulk bag liner from a lay flat type tube 10 of low density polyethylene film of preferably 3 to 8 mils thickness. The lay flat tube is longitudinally creased to have four distinct sides 11. The sides may, for example, each be 42 inches square or 42 by 48 inches, as shown, which is the current size used for grocery pallet type bulk bags.

Figures 2, 3, 4:
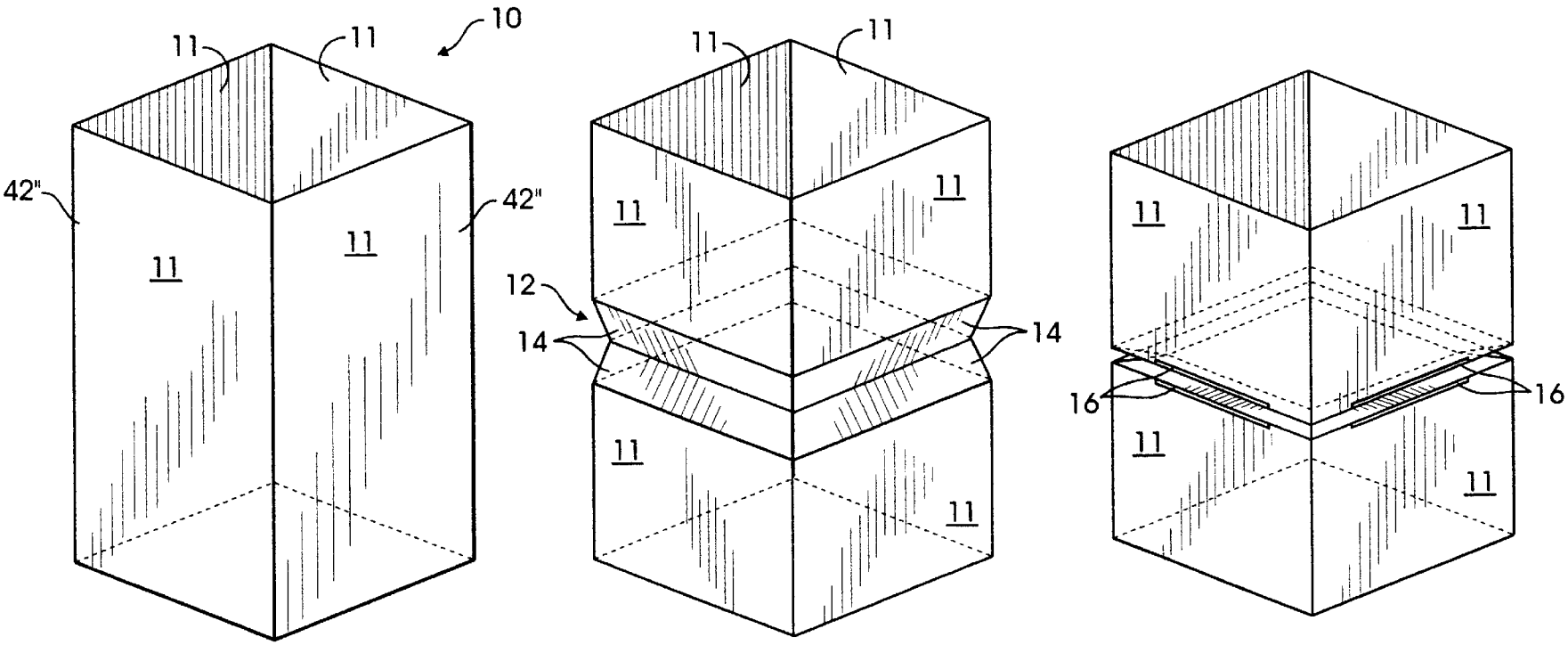
FIGS. 2–6 provide a sequence of perspective views showing a liner being formed in accordance with principles of the invention.
Figure 6:
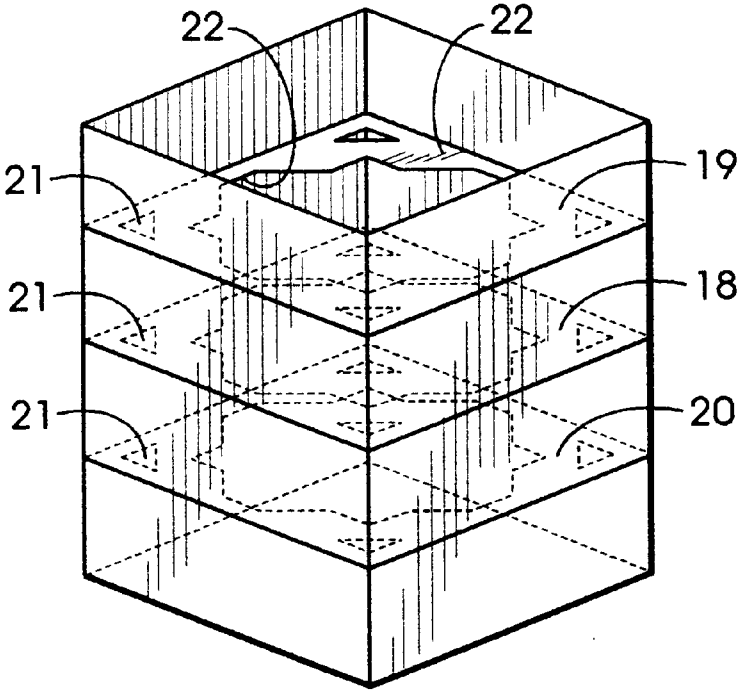

As shown in FIG. 3 a mid portion of the sides is tucked inwardly as shown at 12 as with conventional platen folding arms or blades. The folding arms located on opposite sides are coplanar and the two pairs located to slide over one another so that there is no interference at their corners. In this manner two contiguous folds 14 are formed in each side substantially along a common plane. They may, for example, be 10 inches wide. In doing so the portions of the sides above and below the folds are drawn together. This is illustrated in FIG. 4, although for clarity of illustration only they are shown slightly apart.

Next, as shown in FIG. 4, the two folds of each side are heat sealed together as shown by seals 16. Actually the seal areas of each fold are designated here for clarity, it being understood that the folds are actually sealed together.

Figure 5:
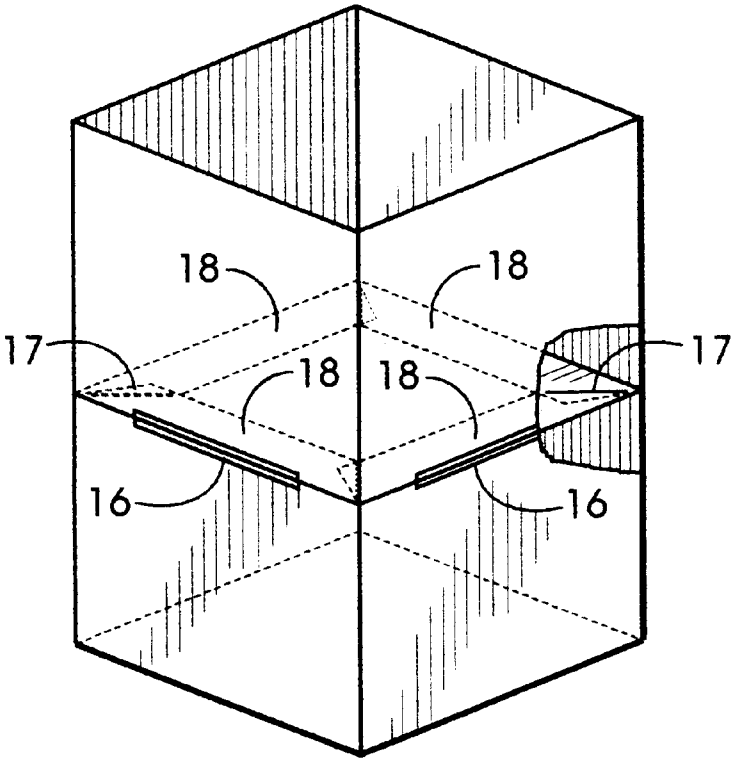

Next, as shown in FIG. 5, four corner heat seals 17 are also formed where the ends of adjacent folds overlap in the corners of the tube 10. In this manner the tube is now formed with four substantially coplanar pleats 18. Following this other coplanar pleats 19 and 20 are formed above and below the pleat 18 in the same manner. Portions of the pleats are then cut away with the results shown in FIG. 6. These portions include the triangular cut-away areas 21 and the thinned mid portions 22. In fact most of the mid portions of the pleats may be trimmed off since it is the corners that primarily provide the anti-bulging reinforcement. A bottom and top, preferably with fill and discharge end chutes, may then be heat sealed to the ends of the tubing to complete the liner.

Figure 7:
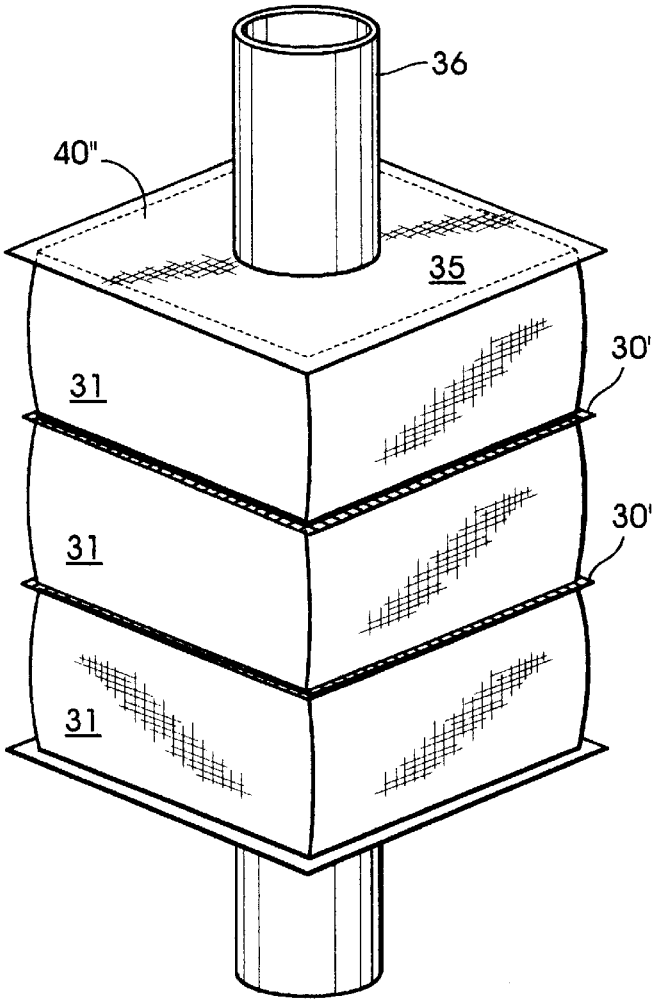
Figure 8:
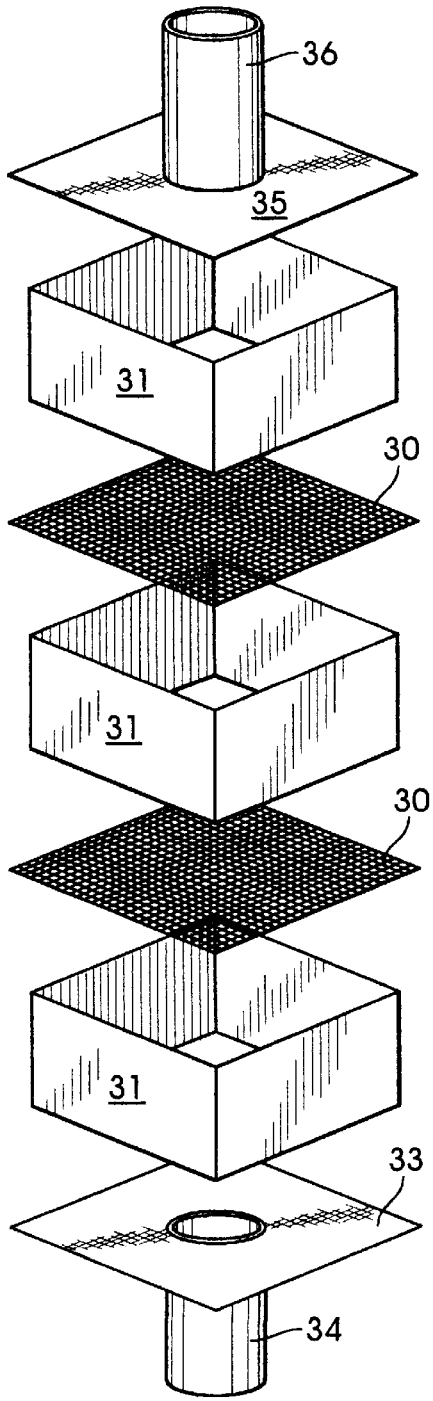
FIG. 8 is an exploded view thereof.

An alternative form of the invention is shown in FIGS. 7 and 8. Here again a tubular liner is provided with anti-bulging members that are oriented transversely to the tube. Here however the transverse members are provided by sheets of woven scrim 30. The liner is produced by providing a series of individual tubular sections 31. Adjacent ends of the sections are folded inwardly to sandwich the periphery of a scrim 30. The folded ends and scrims are then heat sealed together. If desired, some of the scrims may then be cut away so as to have central openings much like that of the pleats of FIG. 6. A bottom 33 with discharge chute 34 is then heat sealed to the bottom section 31 and a top 35 with fill chute 36 heat sealed to the top section 31. The protruding portions 30' of the scrim shown in FIG. 7 are then trimmed off.

Once formed, the liner of either of the just described embodiments is inserted into a woven fabric bulk bag 40 such as one made of woven polypropolyene. The bag has a fill chute 41 and a discharge chute 42 as shown in FIG. 1. It also has four straps 43 at its corners by which it may be suspended from ancillary supports 45. The inside of the bag is lined with the liner which typically also lines the insides of the fill and discharge chutes. Once filled the bag and liner are forced into a skin tight configuration whereupon the pleats or scrim locations become apparent, as shown at 46 in FIG. 1.

It thus is seen that a bulk bag is now provided that resists bulging upon being filled and which may be produced with improved production and cost efficiencies. While the inventive bag has been shown in its preferred forms, it should be understood that many modifications, additions and deletions made be made thereto without departure from the spirit and scope of the invention as set forth in the following claims.

What is claimed is:

1. A bulk bag having side walls and a bottom in which a liner is inserted made of a flexible plastic material, and wherein said liner has a bottom and a plurality of sides and at least one woven scrim frame member extending inwardly from said sides substantially along a plane oriented substantially parallel with said bottom.

2. A bulk bag having side walls and a bottom in which a liner is inserted that is made of flexible plastic material, said liner having a bottom and side walls and an open mesh screen mounted to said sides over said liner bottom, whereby the bulk bag may be filled by pouring bulk materials into the liner which pass through the mesh screen and accumulate both below and above the mesh screen and the mesh screen limits bulging of the bulk bag while filled.

3. The bulk bag of claim 2 wherein each of said liner sides has two discrete sections with inturned flanges that sandwich edges of said open mesh screen and which are sealed together.

4. A bulk bag having side walls and a bottom in which a liner is inserted made of flexible plastic material, said liner having a bottom and side walls, and wherein said liner side walls have inturned, overlapped sealed flanges that form a reinforced frame over said liner bottom to limit bulging of the bulk bag when filled with bulk material and further comprising an open mesh screen having a peripheral portion sandwiched between said flanges.

* * * * *